US010089811B2

(12) United States Patent
Ufkes

(10) Patent No.: US 10,089,811 B2
(45) Date of Patent: Oct. 2, 2018

(54) LOCK

(75) Inventor: Philip J. Ufkes, Mt Pleasant, SC (US)

(73) Assignee: Security Enhancement Systems, LLC, Northbrook, IL (US)

( * ) Notice: Subject to any disclaimer, the term of this patent is extended or adjusted under 35 U.S.C. 154(b) by 0 days.

(21) Appl. No.: 13/414,348

(22) Filed: Mar. 7, 2012

(65) Prior Publication Data

US 2012/0229251 A1 Sep. 13, 2012

Related U.S. Application Data

(60) Provisional application No. 61/450,185, filed on Mar. 8, 2011.

(51) Int. Cl.

| | |
|---|---|
| ***G07C 9/00*** | (2006.01) |
| ***E05B 47/00*** | (2006.01) |
| ***E05B 47/06*** | (2006.01) |
| ***E05B 83/10*** | (2014.01) |
| *E05B 45/06* | (2006.01) |
| *E05C 19/18* | (2006.01) |

(52) U.S. Cl.

CPC ..... *G07C 9/0069* (2013.01); *E05B 47/0004* (2013.01); *E05B 47/0603* (2013.01); *E05B 83/10* (2013.01); *E05B 45/06* (2013.01); *E05B 2045/067* (2013.01); *E05B 2047/0058* (2013.01); *E05B 2047/0067* (2013.01); *E05C 19/186* (2013.01)

(58) Field of Classification Search

CPC .. E05B 47/0004; E05B 47/0603; E05B 83/10; G07C 9/0069

USPC .... 340/5.1, 5.2, 5.21, 5.22, 5.23, 5.24, 5.25, 340/5.26, 5.3, 5.5, 5.6, 5.61, 5.62, 5.7, 340/5.71, 5.72, 5.73

See application file for complete search history.

(56) References Cited

U.S. PATENT DOCUMENTS

| | | | |
|---|---|---|---|
| 3,129,027 | A | 4/1964 | Sussina |
| 3,148,748 | A | 9/1964 | Young |
| 3,423,968 | A | 1/1969 | Foote |
| 3,489,015 | A | 1/1970 | Harris |

(Continued)

OTHER PUBLICATIONS

International Search Report, International Application No. PCT/US2012/028073, dated Oct. 18, 2012. Korean Intellectual Property Office, Daejeon Metropolitan City, KR.

(Continued)

*Primary Examiner* — Nabil Syed

(74) *Attorney, Agent, or Firm* — Gregory Finch; Finch Paolino, LLC

(57) ABSTRACT

An electro-mechanical lock for cargo containers or similar enclosed spaces such as storage units. The locking mechanism includes a dual-ratcheting mechanism, which is normally in the locked position, and which firmly secures doors of a container or other enclosure. To unlock the device, the user obtains a temporary access code and unlocks the device, either by a wireless interface or by, for example, a key pad. The device incorporates a rolling access code algorithm that changes the access code based upon a pre-defined customer selected time period during which the code is valid. Once the validity period expires the user must obtain a new access code from a secure access code source to unlock the device. When access is desired, the user contacts a remote secure access code source, which provides the access code for the associated lock and time period.

13 Claims, 15 Drawing Sheets

(56) References Cited

U.S. PATENT DOCUMENTS

| | | | | |
|---|---|---|---|---|
| 3,563,593 | A | 2/1971 | Leier et al. | |
| 3,596,961 | A | 8/1971 | Lippman | |
| 4,213,118 | A | 7/1980 | Genest et al. | |
| 4,609,780 | A | 9/1986 | Clark | |
| 4,614,861 | A | 9/1986 | Pavlov et al. | |
| 4,619,122 | A | 10/1986 | Simpson | |
| 5,021,776 | A | 6/1991 | Anderson et al. | |
| 5,145,222 | A | 9/1992 | Meyer | |
| 5,265,454 | A | 11/1993 | Crocco et al. | |
| 5,467,619 | A | 11/1995 | Stillwagon et al. | |
| 5,603,534 | A | 2/1997 | Fuller | |
| 5,640,139 | A | 6/1997 | Egeberg | |
| 5,755,175 | A | 5/1998 | White et al. | |
| 5,791,176 | A | 8/1998 | Montesinos Alonso | |
| 5,819,561 | A | 10/1998 | Blehi, III | |
| 5,927,769 | A | 7/1999 | Pullen | |
| 6,098,433 | A | 8/2000 | Maniaci | |
| 6,217,087 | B1 | 4/2001 | Fuller | |
| 6,525,644 | B1 | 2/2003 | Stillwagon | |
| 6,583,713 | B1 * | 6/2003 | Bates | G06Q 50/28 340/10.51 |
| 6,755,450 | B1 | 6/2004 | Chen | |
| 6,788,068 | B2 | 8/2004 | Wolfe | |
| 7,044,512 | B1 | 5/2006 | Moreno | |
| 7,379,805 | B2 | 5/2008 | Olsen, III et al. | |
| 7,526,934 | B2 | 5/2009 | Conforti | |
| 7,624,280 | B2 | 11/2009 | Oskari | |
| 7,828,343 | B2 | 11/2010 | Terry et al. | |
| 7,828,344 | B2 | 11/2010 | Terry et al. | |
| 7,828,346 | B2 | 11/2010 | Terry et al. | |
| 7,835,955 | B1 | 11/2010 | Brodsky et al. | |
| 7,883,127 | B2 | 2/2011 | Terry et al. | |
| 7,883,128 | B2 | 2/2011 | Terry et al. | |
| 2003/0112118 | A1 | 6/2003 | Raslan | |
| 2003/0179075 | A1 * | 9/2003 | Greenman | 340/5.54 |
| 2004/0237609 | A1 | 12/2004 | Hosselet | |
| 2005/0099262 | A1 | 5/2005 | Childress et al. | |
| 2005/0264400 | A1 | 12/2005 | Fisher | |
| 2006/0170533 | A1 * | 8/2006 | Chioiu et al. | 340/5.61 |
| 2007/0271112 | A1 * | 11/2007 | Davis | 705/1 |
| 2008/0041124 | A1 | 2/2008 | Rudd | |
| 2008/0256991 | A1 | 10/2008 | Goldman | |
| 2009/0021369 | A1 * | 1/2009 | Ulrich | G06Q 10/087 340/539.13 |
| 2009/0134999 | A1 * | 5/2009 | Dobson et al. | 340/539.1 |
| 2009/0135015 | A1 | 5/2009 | Dobson et al. | |
| 2009/0211316 | A1 | 8/2009 | Butler et al. | |
| 2010/0106291 | A1 * | 4/2010 | Campbell et al. | 700/231 |
| 2010/0176919 | A1 * | 7/2010 | Myers et al. | 340/5.73 |
| 2010/0214077 | A1 | 8/2010 | Terry et al. | |
| 2010/0328031 | A1 * | 12/2010 | Powers | E05B 39/005 340/5.64 |
| 2011/0018707 | A1 | 1/2011 | Dobson et al. | |
| 2011/0050391 | A1 * | 3/2011 | Denison et al. | 340/5.51 |
| 2012/0013437 | A1 * | 1/2012 | Yokoi et al. | 340/5.82 |
| 2012/0066511 | A1 * | 3/2012 | Scheidt et al. | 713/189 |

OTHER PUBLICATIONS

Written Opinion of the ISA, International Application No. PCT/US2012/028073, dated Oct. 18, 2012. Korean Intellectual Property Office, Daejeon Metropolitan City, KR.

* cited by examiner

LOCK

This application claims the benefit of U.S. Provisional Application Ser. No. 61/450,185 filed Mar. 8, 2011.

BACKGROUND OF THE INVENTION

Intermodal security is a major concern for all businesses that need to ship material goods via truck, rail and sea.

According to a recent report released by Federal Bureau of Investigation (FBI), industry experts estimate all cargo theft adds up to $30 billion each year. Besides thieves who break into random cargo containers, there have been instances where the driver responsible for the cargo is directly involved in the robbery. The FBI has also identified this and has attributed an offense code to 'driver involved cargo theft' in its Uniform Crime Report (UCR).

Locking devices and technologies currently available in the market limit themselves to physically locking the containers. Most of these products are one-time use products or require a physical key or combination for operation. The biggest disadvantage in this case is the lack of accountability in the event of theft. These devices offer no assistance in determining when and where the intrusion might have occurred.

A single-use lock requires additional cutting tools. Also, if the container needs to be opened at the request of law enforcement officials, it requires that the bolt be cut and a new bolt be installed. All of the cut bolts are either wasted or are recycled, which involves additional handling and shipping expenses.

In case of locking devices with a physical key or combination, there is a no record of when the lock has been operated. This situation can be used to the advantage of drivers, who often control the combination or key, with criminal intent who can tamper with the goods on board. Other reusable locks available come with a recurring expense of bolt-seal for each use.

Another aspect of cargo security is financial accountability in the event of theft. Cargo containers delivering goods usually see multiple modes of transportation including sea, train and road. When cargo theft occurs on such a complex route involving multiple individuals and shipping companies and if no proof exists as to when the theft occurred, it becomes extremely difficult for the insurance companies to determine financial responsibility.

Besides cargo theft, containers have also been targeted to smuggle illegal goods and people. US Customs and Border Protection (CBP) uses expensive technologies like X-ray, to deter these illegal activities. A security mechanism, which provides an electronic manifest of goods on board, an electronic log detailing the date and time when the container was accessed, and tamper sensors to provide a high level of confidence that the container was not compromised in transit is needed as an inexpensive and time-saving screening option for low-risk cargo.

The intermodal industry needs an affordable security solution which includes locking, event logging, tamper monitoring and optional GPS tracking.

SUMMARY OF THE INVENTION

The present invention is a re-usable, electro-mechanical, event-logging lock for cargo containers or similar enclosed spaces such as storage units. The robust locking mechanism includes a dual ratcheting cam, which firmly secures doors of a container or other enclosure. The lock continuously monitors lock status and detects tampering. The lock logs all operation and tampering events with a date and time stamp. The device is rugged, simple to operate, resistant to tampering, and will endure shock, rough handling and extreme weather conditions.

To unlock the device, the user obtains a temporary access code and unlocks the device, either by a wireless interface or by a physically connected interface such as, for example, a key pad. The device incorporates a rolling access code algorithm that changes the access code based upon a predefined and customer selected time period during which the code is valid. Once the validity period expires the user must obtain a new access code from a secure access code source to unlock the device. When access is desired, the user contacts a remote secure access code source, which provides the access code for the associated lock and time period. No form communication, wireless or otherwise, from the device to the access code source is required.

DETAILED DESCRIPTION OF PREFERRED EMBODIMENTS

A preferred embodiment provides a secure locking mechanism which can be used with shipping containers, including ISO styled cargo containers. Cargo container doors typically have vertical keeper bars, which are generally parallel bars, permanently attached to the doors of the container to secure the doors in the closed position during transit or storage. In a preferred embodiment, the device is constructed and arranged to be installed on the keeper bars. Once the embodiment is properly installed on keeper bars and locked, access to the container is prohibited. An alternate embodiment may be permanently installed on the interior of the container, such as the doors, or similar enclosure.

Figure 1:
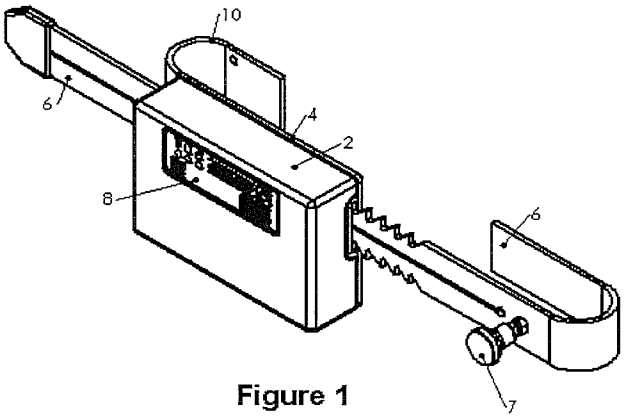
FIG. 1 is a front isometric view of a preferred embodiment

FIG. 1 shows a preferred embodiment of the invention when fully assembled. Front cover assembly 2, back plate assembly 4, and locking bar assembly 6 are the three major sub-assemblies involved. The locking bar 6, which may be a J-shaped bar, or referred to as a J-bar, is inserted by slidable engagement with the lock, and retained in the lock that is present within the back plate assembly. A J-Bar assist handle 7 may be attached to the J-Bar to ease J-Bar operation. User interface 8 is present on the housing. The back plate of this embodiment has a U shaped member 10, or U-bar, that is opposite the J-bar.

Figure 2:
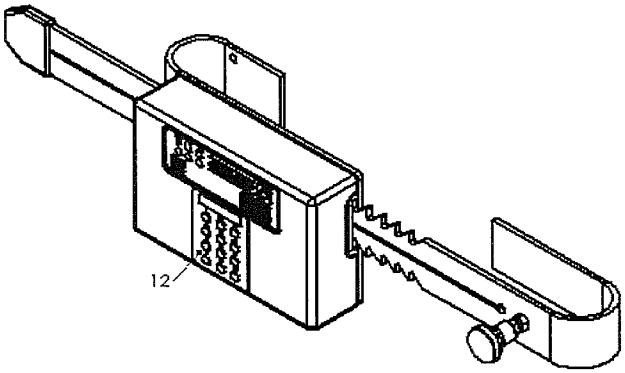
FIG. 2 is a front isometric view of another embodiment showing keypad

FIG. 2 shows an alternate embodiment of the invention that includes all of the elements of the embodiment of FIG. 1. This embodiment further includes a keypad user interface 12 which may be used to enter an access code to unlock the device.

Figure 3:
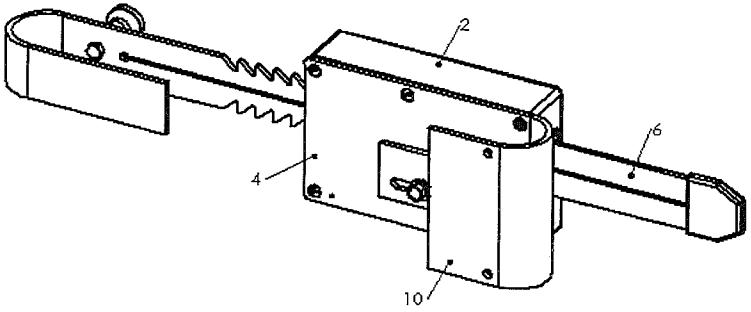
FIG. 3 is a rear isometric view of a preferred embodiment
Figure 6:
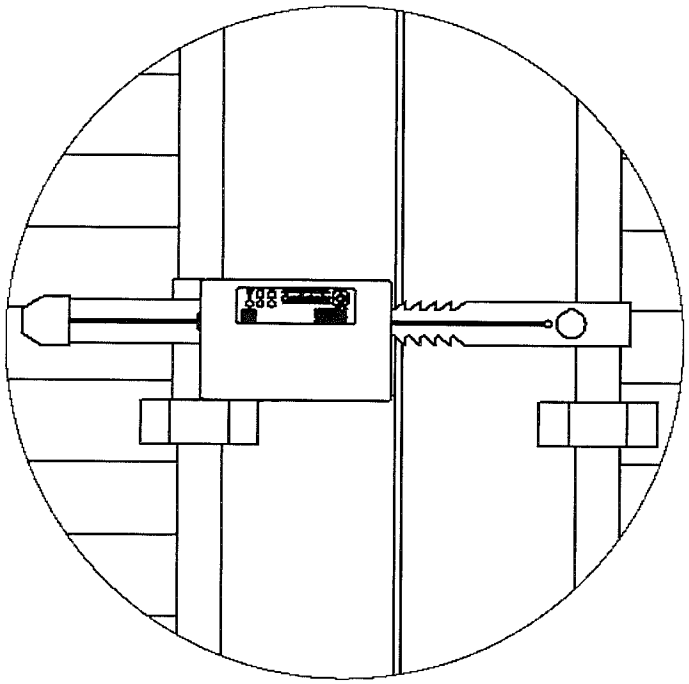
FIG. 6 is a front isometric view of a preferred embodiment installed on an ISO container's keeper bars.

FIG. 3 shows a rear isometric view of an embodiment of the invention when fully assembled. The U-bar 10, which may be formed as an extension of the back plate 4, is installed on one keeper bar of the container. The sliding J-bar 6 is installed on the other keeper bar. The J-bar may be positioned as required to ensure a snug fit between the device and the keeper bars; FIG. 6.

Figure 4:
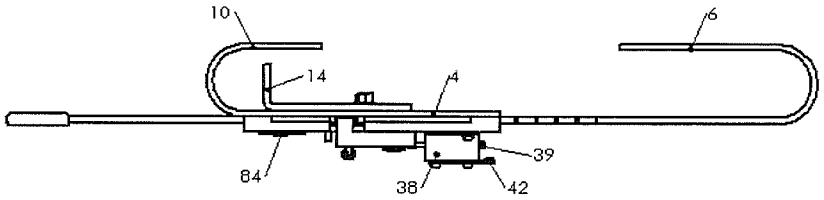
FIG. 4 is a top view of a locking mechanism

FIG. 4 shows a top view of an embodiment of the device with the front cover assembly removed. Mounting clamp 14 may be used with the U-bar 10 to secure the device on keeper bar while allowing the device to be rotated clear when opening the container. This construct inhibits the device from accidentally falling, thereby promoting safe use of the device. Once the embodiment is unlocked, the J-bar may be slidably extended, and the device may be rotated around the U-bar axis. Unencumbered access to the container is now available. This mounting clamp configuration eliminates the need to completely uninstall the embodiment from the container to gain access; thereby reducing cycle time while improving operational safety.

Figure 5:
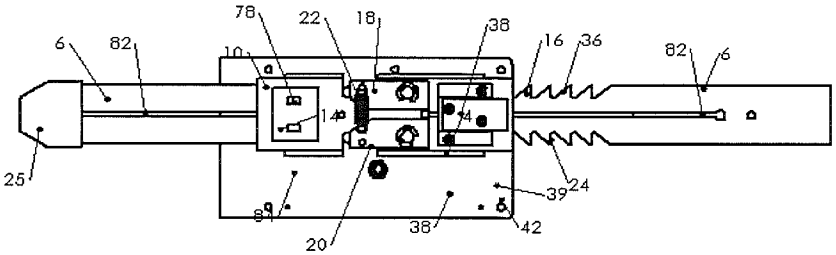
FIG. 5 is a front view of the locking mechanism according to FIG. 4.

FIG. 5 shows a front view of an embodiment of the back plate assembly 4 in the locked state with the front cover assembly 2 removed. The locking mechanism of this embodiment uses two locking levers 18, 20 that engage the valleys of the teeth 16 of the sliding J-bar 6, preventing removal of the J-bar until the levers are disengaged by the operator. The locking mechanism operates on a cam principle, where the peaks and valleys of the teeth 16 act as a cam and the locking levers act as cam followers. The locking levers are held in a default locked position with the J-bar teeth fully engaged by a contraction spring 22. The teeth of the J-bar preferably incorporate a slight inward angle, with edges 24 not being entirely vertical, as shown in the orientation of FIG. 5. A linear opening (pulling) force applied to the J-bar results in the locking levers being pulled inwards by edges 24 toward the J-bar; thus ensuring the lock remains secure. Using the same cam principle while in the unlocked state, the locking levers are opened by the J-bar edges 36 as closing (pushing) force is applied to move the J-bar in the locking direction, but the levers will latch close when force is applied to pull the J-bar in the opposite direction. This allows the operator to install the J-bar easily with a ratcheting operation, but prevents movement of the J-bar in the opposite direction.

Figure 12:
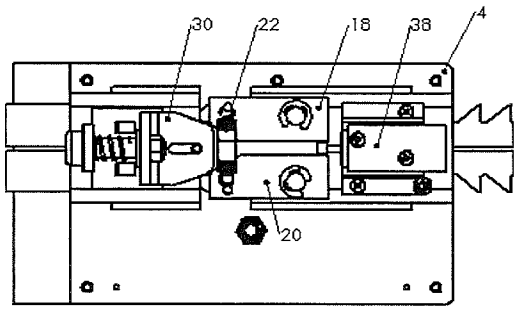
FIG. 12 shows a front view of an embodiment of the locking mechanism in the locked state.
Figure 13:
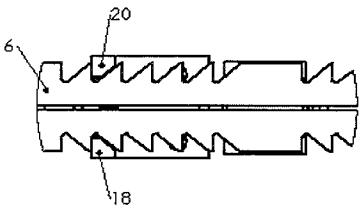
FIG. 13 shows a rear view of the locking mechanism of FIG. 12 when locked.

FIGS. 12 and 13 show further detail of the locking mechanism of a preferred embodiment in the locked state. In the locked state the J-bar is held firmly in position by the locking levers and cannot be opened (pulled) or closed (pushed). An important aspect of the locking mechanism is preventing rotation of the locking levers while in the locked state. In one embodiment, this is accomplished by a locking and unlocking actuator that comprises an electric double position linear solenoid 38. Back plate assembly 4 comprises locking levers 18, 20 that are held in position by the normally extended piston of the solenoid 38, which inhibits movement (rotation) of the locking levers that are urged toward each other by contraction spring 22. The solenoid piston, when extended, is physically positioned between the locking levers 18, 20, which prevents the release cam 30 from opening the locking levers to allow insertion or removal of the J-bar. Furthermore, the solenoid piston also prevents movement of the locking levers caused by external tampering, such as shock impacts of a sledge hammer. Only when the solenoid piston is retracted can the release button be depressed to actuate the release cam and allow the removal of the J-bar.

In one embodiment, a magnet 39 is installed on the edge of the solenoid piston as shown in FIG. 4. A Hall Effect sensor 42 may be used to continuously monitor the magnetic field of the magnet. The solenoid piston position may be thereby monitored and the state of the lock determined.

Figure 8:
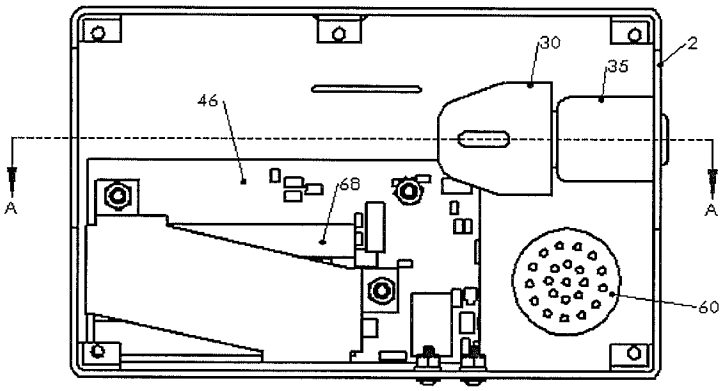
FIG. 8 is a rear view of the cover assembly of FIG. 7.
Figure 9:
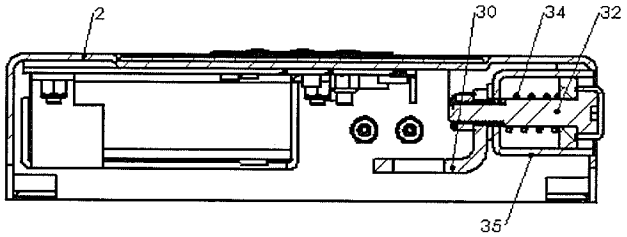
FIG. 9 is the section A-A view of the cover assembly of FIG. 8.

FIG. 8 shows a rear view of the cover assembly and FIG. 9 shows a section view of FIG. 8. Using the cam follower principle, a release cam 30 is employed in this embodiment to rotate the locking levers and allow the opening (pulling) of the J-bar. This second cam is attached to a release actuator, which may be a depressible button 32, positioned on, for example, the left side of the cover assembly 2. The release button is pressed and displaced, which actuates release cam 30, rotating the locking levers, and allowing the operator to extend the J-bar. The release button and subsequently the release cam return to their original position with the help of expansion spring 34. The release button mechanism is recessed in the cover assembly 2 and enclosed in a protective shroud 35 to inhibit damage from tampering. In an embodiment, the button 32 can spin in any direction without affecting the locking mechanism, so as to further inhibit damage from tampering.

Figure 14:
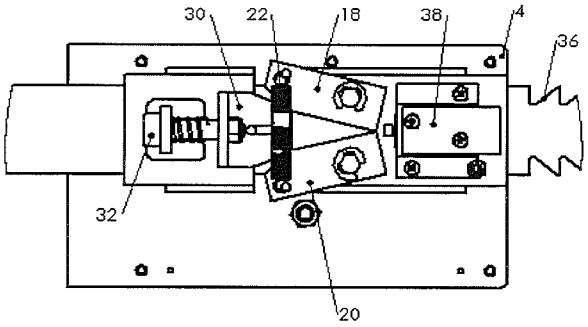
FIG. 14 shows a front view of an embodiment of the locking mechanism of FIG. 12 in the unlocked state.
Figure 15:
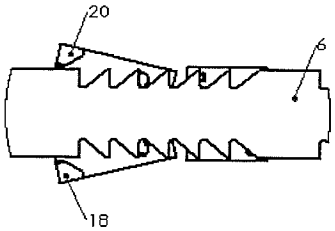
FIG. 15 shows a rear view of the locking mechanism of FIG. 12 in the unlocked state.

FIG. 14 shows the device in the unlocked state with the solenoid piston retracted into the solenoid 38. The releasing cam 40 is shown in the actuated position by the release button 32 between the locking levers 18, 20 thereby rotating the locking levers away from the teeth of the sliding J-bar and disengaging them from the teeth. When the locking levers are disengaged from the teeth, the sliding J-bar may be extended (pulled) from the housing; the device is unlocked. FIG. 15 demonstrates the interaction between the locking levers 18, 20 and the sliding J-bar 6 during the J-bar retraction (removal) step. With the locking mechanism in the unlocked state and cam 40 in the retracted (rest) position, the negative angle 36 on the sliding J-bar 6 tooth rotates the locking levers and permits insertion (push) of the J-bar with a ratcheting action.

Figure 7:
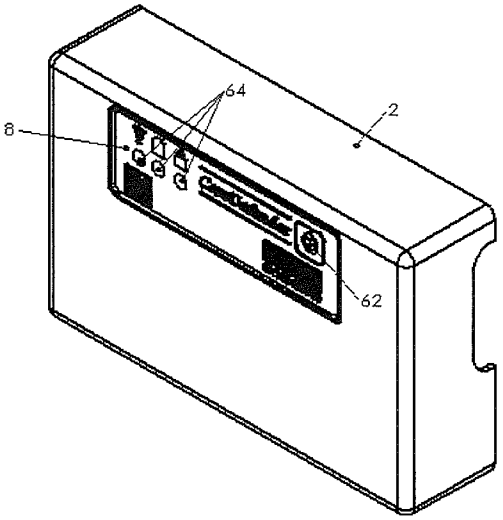
FIG. 7 is a front isometric view of a cover assembly of a preferred embodiment.

FIG. 7 shows the front cover assembly of an embodiment having a Human Machine Interface (HMI) 44. In the embodiment shown, the HMI has one button 62 and three Light Emitting Diodes (LED) 64. The status LEDs on the HMI show the condition of the lock. For example, each LED may be assigned to one of the following: wireless (such as Bluetooth) connection status, battery status and lock state of the embodiment. More or fewer LEDs may be used to provide visual indications of various conditions of the lock. The button 62 may be used to wake the device from a low power (sleep) state; a single push wakes the microcontroller which then activates the wireless interface and illuminates the status LEDs accordingly. Pushing and holding button 62 for more than two seconds may cause the device to change from the unlocked state to the locked state; the lock status LED changing color accordingly.

Figure 10:
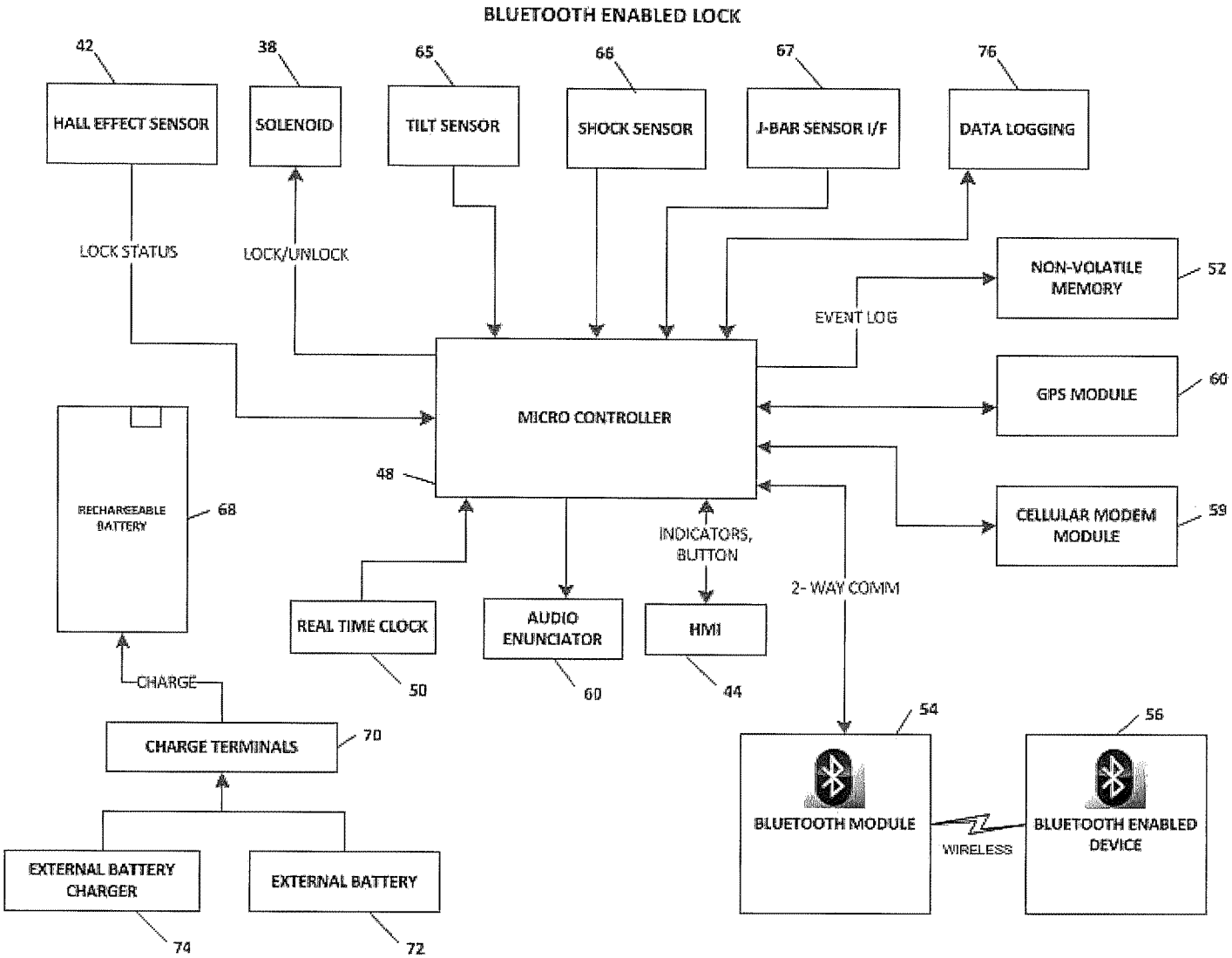
FIG. 10 is a system block diagram view of a circuit card assembly (CCA) schematic for an embodiment of the invention.

FIG. 8 shows a rear view of the cover housing for a Circuit Card Assembly (CCA) 46 that may be used in a preferred embodiment. FIG. 10 shows a block diagram view of a preferred CCA schematic. The CCA in this embodiment has a microcontroller 48 which keeps track of critical components and runs algorithms for proper functioning of the device. A wireless device, such as a Bluetooth module 54 on the CCA, communicates with the microcontroller, and enables the device to connect with other Bluetooth enabled devices 56. Optionally, the CCA incorporates a cellular modem 59 and/or GPS module 60 in a mother-daughter board arrangement.

A precise Real Time Clock (RTC) module 50 and a non-volatile memory (memory) 52 are other components of the preferred CCA; FIG. 10. When the embodiment wakes up from the low power sleep state the time and date are obtained from the RTC for use in the rolling access code calculation algorithm. When the embodiment is locked, unlocked or tampering is detected the time and date are obtained from the RTC for notating the date and time of the event (time-stamping) in the event log stored in memory. The event log, manifest, user settings, random code generation tables (E-Code) and device specific information such as the unique device serial number are stored in the memory for future retrieval.

In preferred embodiments, the Real-Time Clock is the principal link between the rolling access code server and the lock. The rolling access code is generated as a function of Date, Time, DSN, E-Code Lookup Table. The Real-Time Clock also provides time-stamping for the Events in the Event Log. With the time stamp, the container can be traced to a specific location or condition at a specific time. For example, a tamper event at 0100 on the $25^{th}$ of February verifies that the container was in the possession of a particular shipping company. If a theft loss is not discovered until days later after the container has passed through multiple transportation companies, the date of the theft can be verified and a claim filed against the transportation company then in possession.

The Non-Volatile Memory may store user settings, such as the Code Validity Period, the event log, such as lock, unlock, and tamper events, and a shipping manifest.

An H-bridge solenoid driver circuit may be used to operate the solenoid.

The embodiment as shown in FIG. 1 is preferred to be a wireless device, which may be a Bluetooth Enabled Device (BED). In this embodiment, a BED and the correct Bluetooth access (pairing) code are required. When the embodiment is locked, it may enter a low power state after a prescribed time period; for example 30 seconds. The button 62 on the HMI 44 is pushed to activate the device and put the Bluetooth module 54 in discovery mode. The blue LED on the HMI starts blinking to indicate that embodiment is in discovery mode and ready to be paired. This embodiment now shows up on the Bluetooth Device list of any BED in close vicinity. The user can pair their BED with the embodiment, thereby unlocking the embodiment. When the embodiment is successfully unlocked, time and date from the RTC are obtained and the unlock event may be stored in memory. The Media Access Control (MAC) Address of the unlocking BED may also be stored during the unlock event.

In one embodiment, the device incorporates a Rolling Access Code scheme that dynamically changes the access (pairing) code based on a pre-defined Code Validity Period (CVP). If a Bluetooth device is used, dynamic changes to the pairing code are provided. Each lock is given a unique Device Serial Number (DSN) and this serial number is saved to the memory present in the lock. The processor of the device may also have a set of code generation tables, each table containing random numbers (E-Code), also stored in memory; for example, 10 pages of 365 tabulated random 8-digit numbers. When CVP expires, the device of this embodiment changes its code, such as the Bluetooth access (pairing) code, thereby rendering the previous code ineffective. For example, if the CVP is defined as 1 hour, at the top of each hour the embodiment changes its Bluetooth access code. A user who obtains the access code within the hour will not be able to use the same code after the top of the next hour.

In a preferred embodiment, the Rolling Access Code (RAC) is determined by a RAC generation algorithm executed by the microcontroller. The effective RAC is computed as a function of the current date and time (T-Code), as provided by the RTC, the unique DSN, as retrieved from memory, and an E-Code selected from a particular code generation table based; for example, on the DSN and the current date. The RAC generation algorithm is suitably designed to negate the affects of numerical calculation errors such as rounding. The RAC generation algorithm may resemble the following function: F(T-Code*E-Code*DSN)=RAC. A preferred embodiment accepts only a 6-digit Bluetooth pairing code, thereby, providing elimination of accidental pairing with other BEDs employing the standard 4-digit Bluetooth pairing code.

In a preferred embodiment, no external communication, such as communication to and from a satellite or cell tower, is required. Each device has a unique DSN and a precise RTC. This allows the current RAC to be calculated by a copy of the algorithm and E-Code tables operated at a location remote from the device, such as a computer server that also has precise date and time information. The current RAC may be obtained from the remote location by telephone or internet communications, and provided to an authorized user who will unlock the lock.

Once authentication of the user is established, for example by a user name and password, the user provides the DSN of the device to be unlocked to the remote location (server). The remote server verifies that the authenticated user is authorized to operate the particular device. For example, the remote server verifies that the provided DSN is within a set of DSNs controlled by the authenticated user's organization. The remote server calculates the current access code and provides the access code to the authenticated authorized user. When using a cellular 'smart' phone, a custom software application (app) may be used to connect to the server site via a Quick Response (QR) code printed on the HMI 8. The smart phone may read the unique DSN via a bar code scanner, camera, Radio Frequency Identification (RFID) tag or similar technology. The application sends this information, along with the user's authentication information, to the secure source via a cellular network or WIFI network. Upon validation, the application transmits the access code to the device.

In a preferred embodiment, the device is equipped with a tilt sensor 65. This sensor is preferred to be activated when the device is in the locked state. In this embodiment, when the device is locked on a container, it can be removed only after its unlocked using a wireless control such as a Bluetooth enabled device. If forced removal of the device from the container results in tilting of the device, any tilt above a predefined limit will be detected by the tilt sensor. For example, a tilt greater than 45 degrees to the original position of the device when locked will be detected by the tilt sensor. This detected tamper event is saved to the event log, with a time and date stamp, in the memory.

In a preferred embodiment, the device is equipped with a programmable shock sensor 66. This sensor is preferred to be activated when the device is in the locked state. When the device is subject to high-g shock, such as from a hammer blow, the shock sensor registers this tamper event. This detected tamper event is saved to the event log, with a time and date stamp, in memory.

In a preferred embodiment, the device employs a J-Bar Tamper Detection Circuit 67; FIG. 5. The J-Bar 6 is designed as one half of a closed electrical circuit and may employ two self-cleaning spring-loaded carbon brushes 78 connected to the CCA 46 to complete the other half of the circuit. The two sides of the stainless steel J-Bar are isolated over the length of the J-bar via a narrow slot 82. At the U-Bar side of the device, the spacing of the J-bar isolation slot is maintained by a molded rubber spacer 25. The factory installed spacer also prevents the J-Bar from being removed from the locking mechanism; positive stop. The J-Bar isolation slot is stress relieved with a circular hole. As an alternate embodiment, an isolated conductor, which may be—a nickel plated copper wire, is bonded to the J-Bar in a "U" shaped channel, and the brushes ride on the conductor. The two brushes are mounted to a Printed Circuit Board (PCB). The PCB, mounted to the J-bar guide of the locking mechanism, provides mechanical alignment and electrical connection to the brushes 78. The self cleaning spring-loaded carbon brushes maintain electrical contact with the J-Bar as it is extended and retracted from the device. When in the locked state, the microcontroller 48 continually monitors the J-Bar tamper detection circuit continuity and logs a tamper event if an open circuit conditions is detected. Cutting the J-Bar will result in an open circuit. This detected tamper event is saved to the event log, with a time and date stamp, in memory.

FIG. 8 shows the Audible Alarm Enunciator 60 which may be used by a preferred embodiment. As determined by the user settings, the audible alarm enunciator is activated when any tamper event is detected thereby drawing attention to the event.

In another embodiment, the memory of the circuit card assembly may comprise data logging 76 to store an inventory log of all goods on board (manifest). This inventory log may be made available only to users with administrative rights (administrators). Administrators can connect to the wireless or Bluetooth module via a Serial Port Profile (SPP) connection. Once this SPP connection is established administrators can download or upload data to the embodiment.

The circuit card assembly may be powered by rechargeable batteries 68, such as Lithium Iron Phosphate batteries. These rechargeable batteries can be charged via the charging terminals 70 available on the embodiment. In the event of completely discharged batteries, the user can connect to an external battery 72 or battery charger 74 to the charging terminals to power the device and unlock the device as required.

Figure 11:
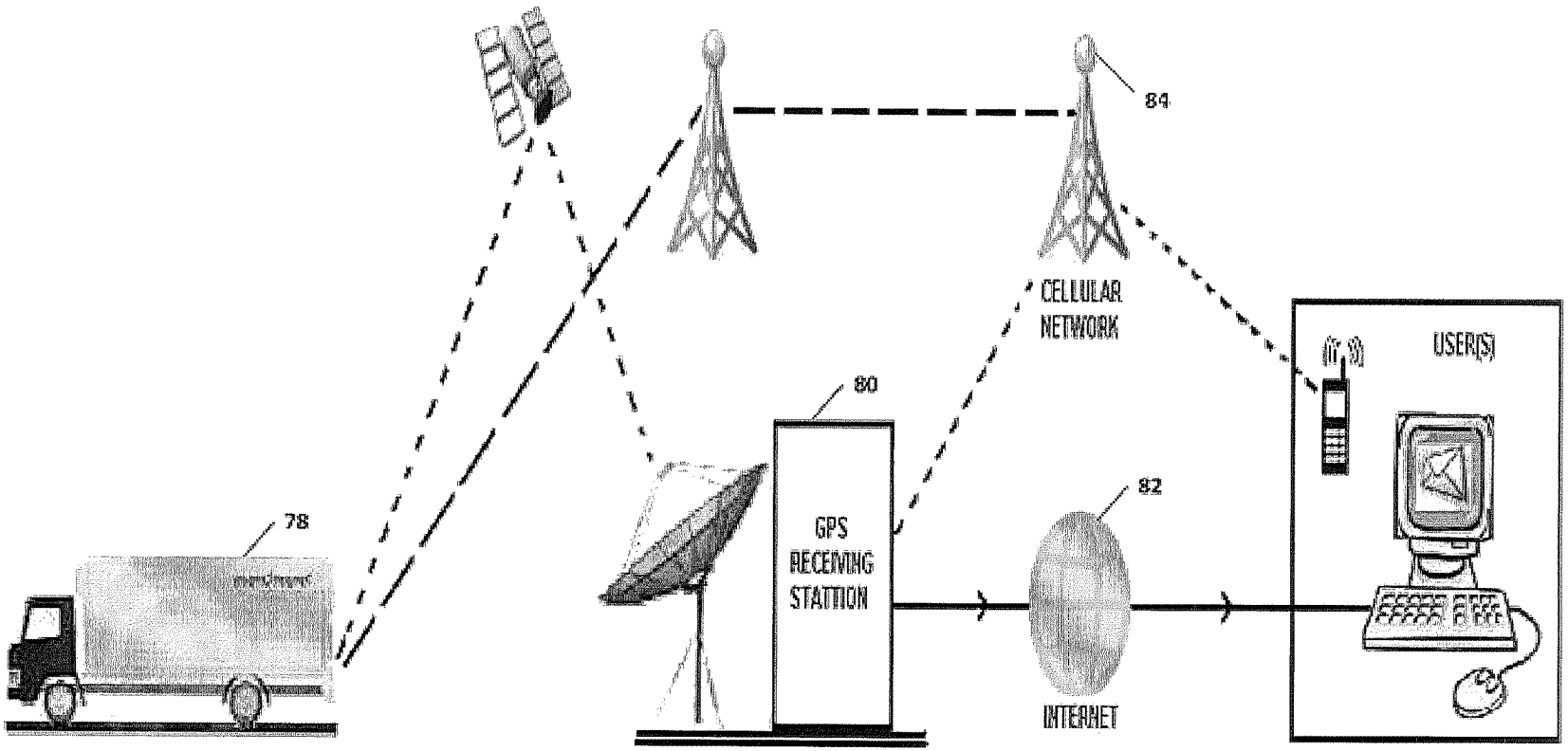
FIG. 11 shows a track security feature wherein an embodiment of the device transmits its geographic location using a wireless transmitter.

FIG. 11 illustrates a tracking security function of another embodiment of the invention. A wireless transmitter 78 that is incorporated into the device transmits the current location of the device. A GPS receiving station 80 receives the location information from the transmitter, relays the location, for example, by internet 82 or cellular connection 84 to produce electronic mail, telephone or text messaging services. The GPS receiving station may upload location details to a mapping service database, which may be accessed as an internet website. In some applications, the device may communicate by radio, such as by communicating directly with the cellular system. Users may log into this website to track a container on a map. The device may communicate when accessed or send a distress signal when tampering is detected.

In the case of a wireless embodiment, such as a Bluetooth Enabled Device, upon access code entry and validation, the device may unlock, and log the event. In another embodiment, the device has a keypad or touchpad 12 as part of the HMI, which may be used to enter the temporary access code. The keypad or touchpad may be provided in addition to the wireless unlocking feature, and entry via this device may also be logged by the device.

Using a wireless connection or a hard-wired connection such as USB, authorized users may download the electronic manifest, container routing information, or other information, into the devices' on-board non-volatile memory. Law enforcement, border patrol or other agencies may access the manifest and the event log using proprietary software running on suitably equipped Bluetooth enabled computing device, such as a smart phone or tablet computer. Law enforcement can thereby be assured of the containers contents, last access date and time, and that the container has not been compromised.

Another embodiment incorporates wireless communication and/or Global Positioning System (GPS) technology onto the microcontroller board. The wireless communication may be traditional cellular technology and/or Short Burst Data Satellite Modem. Using the GPS or cellular network, this embodiment periodically determines the position of the secured container. An internal tracking algorithm determines if the secured container is within the dimensional bounds of the pre-programmed tracking, such as by position and time. Should the experienced track of the device and container violate the bounds of the expected track, an event is logged and the upgraded embodiment broadcasts an alert using the installed wireless network. A track violation occurs when the device is not within the scheduled grid established by the scheduled date and time.

In one embodiment, a wireless transmitter transmits location information on a frequent basis. A wireless receiving station on the other end receives the location. Pre-defined routes are downloaded to the wireless receiving station. With available route information and incoming information from the device, the wireless station determines if there is a route mismatch. The wireless receiving station notifies relevant parties, such as by telephone, e-mail or text messaging services. The wireless receiving station may upload location details to a mapping service, such as a website having mapping. Users can log track the subject container on a map. Wireless transmission and wireless reception means include, but are not limited to, Global Positioning Systems or modems.

In an embodiment, upon detection of a tamper event, the device transmits its location and all pertinent information, such as special manifest information, via the wireless communications network.

What is claimed is:

1. A method of verifying the integrity of a shipping container, the method comprising:

selectively coupling a lock to a mobile shipping container, the lock having a U-shaped bar and a J-shaped bar being operably engaged to secure a door of the mobile shipping container, the lock being configured to rotate around an axis of the U-shaped bar when in an unlocked configuration;

tracking, with a global positioning system, the global position of the lock selectively coupled to the mobile shipping container, the lock having a first processor operable to execute an internal tracking algorithm;

determining, by a handheld device, an identifier of the lock selectively coupled to the mobile shipping container, the lock configured to selectively secure an entry door of the mobile shipping container, the lock configured to be actuated to an unlocked position by entry of an access code into the first processor, wherein the lock is configured to store an event log relating to actuation of the lock and information about the mobile shipping container, the information comprising manifest and routing data related to contents and location of the mobile shipping container, and wherein the lock is configured to be accessed by one or more separate devices to retrieve the event log and information about the mobile shipping container;

communicating, by the handheld device, with a second processor that is located at a location that is remote from the lock to provide authentication information and the determined identifier to the second processor;

receiving the access code from the second processor at the handheld device by internet connection, wherein the access code is generated in response to authorizing the handheld device based on at least the determined identifier;

transmitting the access code to the lock wherein the access code is processed by the first processor to actuate the lock to the unlocked position; and, wirelessly communicating status information about the lock to the handheld device.

2. The method of claim 1, wherein the lock comprises a real time clock, and further comprising the real time clock providing time and date information to the first processor, and the first processor generating changes in the access code that are a function of the time, the date and a code taken from a code generation table of the first processor.

3. The method of claim 1, wherein the identifier is a unique serial number, and wherein the access code is generated by computing an encrypted deterministic algorithm using the serial number of the lock and a current date and time and a code taken from a code generation table.

4. The method of claim 1, wherein the lock further comprises a locking and unlocking actuator comprising an electric double position linear solenoid.

5. The method of claim 4, wherein the lock comprises a first locking lever and a second locking lever being operably engaged with the electric double position linear solenoid in a rotationally fixed position.

6. The method of claim 1, wherein the J-shaped bar comprises a first half of a tamper detection circuit.

7. The method of claim 1, wherein the lock comprises a shock sensor, and further comprising storing a date and time of the lock receiving a mechanical force sufficient to actuate the shock sensor in the event log.

8. The method of claim 1, wherein the lock comprises a tilt sensor, and further comprising storing in the lock event log a date and time of movement of the lock to an angle that actuates the tilt sensor.

9. The method of claim 6, further comprising at least one spring-loaded carbon brush operably connected to a circuit card assembly, the at least one spring-loaded carbon brush comprising a second half of the tamper detection circuit.

10. The method of claim 9, wherein the at least one spring-loaded carbon brush is configured to maintain electrical contact with the J-shaped bar in a locked and unlocked configuration to maintain a closed circuit.

11. The method of claim 1, wherein determining the identifier comprises scanning a QR code, a bar code, an RFID tag, or a combination thereof.

12. A method comprising:

selectively coupling a lock to a mobile shipping container, the lock having a U-shaped bar and a J-shaped bar being operably engaged to secure a door of the mobile shipping container, the lock being configured to rotate around an axis of the U-shaped bar when in an unlocked configuration;

tracking, with a global positioning system, the global position of the lock selectively coupled to the mobile shipping container, the lock having a first processor operable to execute an internal tracking algorithm, the internal tracking algorithm being operable to track dimensional bounds of the mobile shipping container in relation to a pre-determined track;

communicating, with a wireless transmitter integral to the lock, tracking data of the lock to a wireless receiving station, the wireless receiving station being operable to evaluate the tracking data to determine a track violation;

determining, by a handheld device, an identifier of the lock selectively coupled to the mobile shipping container, the lock configured to selectively secure an entry door of the mobile shipping container, the lock configured to be actuated to an unlocked position by entry of an access code into the first processor, wherein the lock is configured to store an event log relating to actuation of the lock and information about the mobile cargo container, the information comprising manifest and routing data related to contents and location of the mobile shipping container, and wherein the lock is configured to be accessed by one or more separate devices to retrieve the event log and information about the mobile shipping container;

communicating, by the handheld device, with a second processor that is located at a location that is remote from the lock to provide authentication information and the determined identifier to the second processor;

receiving the access code from the second processor at the handheld device by internet connection, wherein the access code is generated in response to authorizing the handheld device based on at least the determined identifier;

transmitting the access code to the lock, wherein the access code is processed by the first processor to actuate the lock to the unlocked position;

wirelessly receiving status information about the lock to the handheld device.

13. The method of claim 12, wherein the J-shaped bar comprises a first half of a closed electrical circuit being operably engaged with the first processor.

* * * * *